US011123988B2

(12) United States Patent
Nishiwaki

(10) Patent No.: US 11,123,988 B2
(45) Date of Patent: Sep. 21, 2021

(54) LIQUID EJECTING HEAD AND LIQUID EJECTING APPARATUS

(71) Applicant: SEIKO EPSON CORPORATION, Tokyo (JP)

(72) Inventor: Tsutomu Nishiwaki, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 1 day.

(21) Appl. No.: 16/857,293

(22) Filed: Apr. 24, 2020

(65) Prior Publication Data

US 2020/0338886 A1 Oct. 29, 2020

(30) Foreign Application Priority Data

Apr. 26, 2019 (JP) ..... JP2019-085193

(51) Int. Cl.

| | |
|---|---|
| ***B41J 2/14*** | (2006.01) |
| ***B41J 2/18*** | (2006.01) |
| ***B41J 2/055*** | (2006.01) |
| ***B41J 2/175*** | (2006.01) |

(52) U.S. Cl.

CPC ..... *B41J 2/1433* (2013.01); *B41J 2/055* (2013.01); *B41J 2/14201* (2013.01); *B41J 2/175* (2013.01); *B41J 2/18* (2013.01)

(58) Field of Classification Search

CPC ..... B41J 2/055

See application file for complete search history.

(56) References Cited

U.S. PATENT DOCUMENTS

| | | | | |
|---|---|---|---|---|
| 5,682,190 | A * | 10/1997 | Hirosawa | B41J 2/14145 347/42 |
| 6,557,989 | B1 * | 5/2003 | Hirosawa | B41J 2/055 347/87 |
| 6,752,489 | B2 * | 6/2004 | Ohashi | B41J 2/14024 347/65 |
| 2016/0311221 | A1 * | 10/2016 | Menzel | B41J 2/1628 |
| 2018/0354259 | A1 * | 12/2018 | Giere | B41J 2/14233 |

FOREIGN PATENT DOCUMENTS

| | | | | |
|---|---|---|---|---|
| JP | 06191030 | A * | 7/1994 | B41J 2/055 |
| JP | 2018-513041 | A | 5/2018 | |

OTHER PUBLICATIONS

Machine-generated English translation of JP-06191030, "Ink Jet Recording Head and Apparatus" to Komata; translation retrieved from www.espace.net on Jun. 10, 2021; 17pp.*

* cited by examiner

*Primary Examiner* — Shelby L Fidler

(74) *Attorney, Agent, or Firm* — Workman Nydegger

(57) ABSTRACT

A liquid ejecting head includes a nozzle substrate in which a nozzle that ejects a liquid is formed and a flow path substrate that is joined to the nozzle substrate. The flow path substrate includes a pressure chamber that communicates with the nozzle and a first liquid storage chamber that stores the liquid to be supplied to the pressure chamber. The nozzle substrate includes a first damper chamber and one or more first hole portions which communicate with the first liquid storage chamber and the first damper chamber and in which a meniscus for absorbing a pressure fluctuation of the liquid in the first liquid storage chamber is formed.

18 Claims, 5 Drawing Sheets

LIQUID EJECTING HEAD AND LIQUID EJECTING APPARATUS

The present application is based on, and claims priority from JP Application Serial Number 2019-085193, filed Apr. 26, 2019, the disclosure of which is hereby incorporated by reference herein in its entirety.

BACKGROUND

1. Technical Field

The present disclosure relates to a technique for ejecting a liquid such as ink.

2. Related Art

A liquid ejecting apparatus that ejects a liquid such as ink from a plurality of nozzles has been proposed in the related art. For example, JP-T-2018-513041 discloses a liquid ejecting apparatus including a pumping chamber, an actuator that causes a fluid to be discharged from the pumping chamber, and a feed channel that communicates with each pumping chamber. A dummy nozzle for absorbing a pressure fluctuation in the feed channel is formed at a bottom surface of the feed channel. The dummy nozzle communicates with the feed channel.

However, in the technique of JP-T-2018-513041, since the dummy nozzle communicates with an external space, a fluid in the feed channel dries and a viscosity of the fluid thus increases. Therefore, performance of absorbing the pressure fluctuation is deteriorated.

SUMMARY

According to an aspect of the present disclosure, a liquid ejecting head includes a nozzle substrate in which a nozzle that ejects a liquid is formed and a flow path substrate that is joined to the nozzle substrate. The flow path substrate includes a pressure chamber that communicates with the nozzle and a first liquid storage chamber that stores the liquid to be supplied to the pressure chamber. The nozzle substrate includes a first damper chamber and one or more first hole portions which communicate with the first liquid storage chamber and the first damper chamber and in which a meniscus for absorbing a pressure fluctuation of the liquid in the first liquid storage chamber is formed.

DESCRIPTION OF EXEMPLARY EMBODIMENTS

A. First Embodiment

Figure 1:
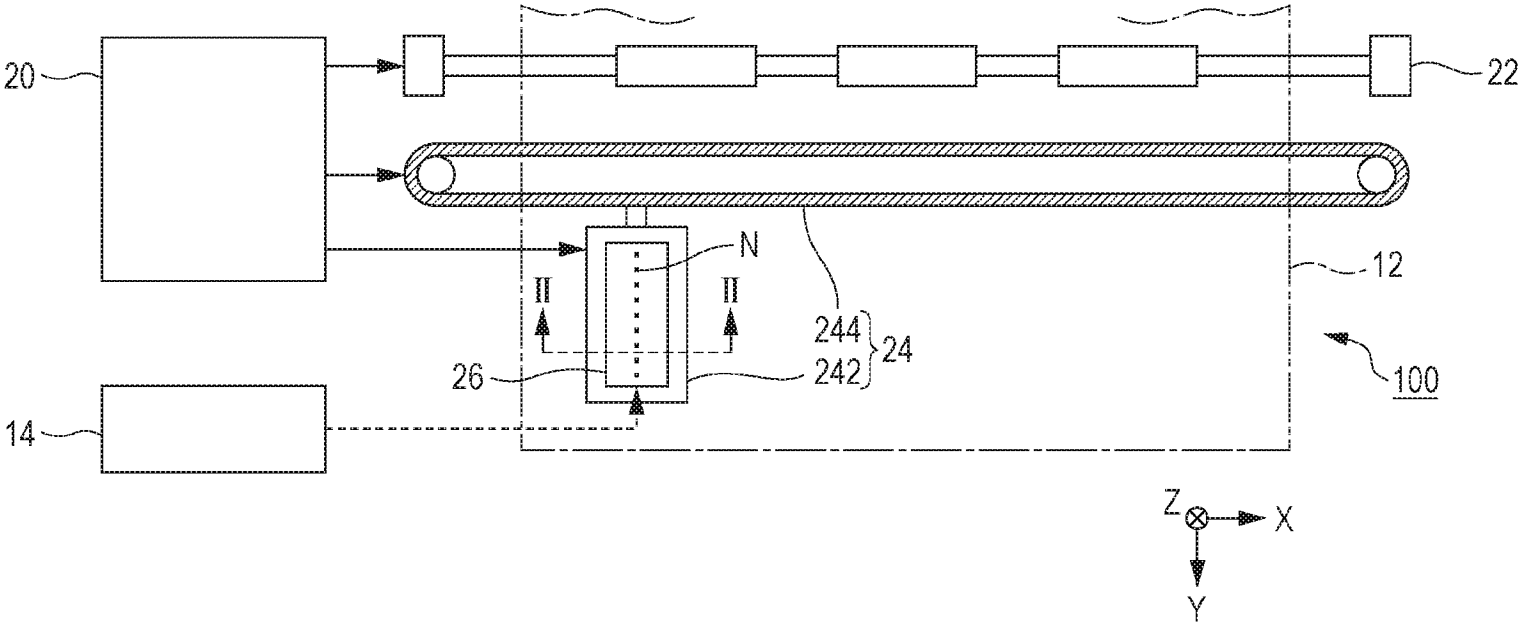
FIG. 1 is a diagram of a liquid ejecting apparatus according to a first embodiment.

FIG. 1 is a diagram illustrating a liquid ejecting apparatus 100 according to a preferred embodiment of the present disclosure. The liquid ejecting apparatus 100 according to the present embodiment is an ink jet printing apparatus that ejects ink, which is an example of a liquid, to a medium 12. The medium 12 is typically printing paper, but a printing target formed of any material such as a resin film or cloth is used as the medium 12. As illustrated in FIG. 1, a liquid container 14 for storing the ink is installed in the liquid ejecting apparatus 100. For example, a cartridge attachable to and detachable from the liquid ejecting apparatus 100, a bag-shaped ink pack formed of a flexible film, or an ink tank that can be replenished with ink is used as the liquid container 14.

As illustrated in FIG. 1, the liquid ejecting apparatus 100 includes a control unit 20, a transport mechanism 22, a moving mechanism 24, and a liquid ejecting head 26. The control unit 20 includes, for example, a processing circuit such as a central processing unit (CPU) or a field programmable gate array (FPGA) and a storage circuit such as a semiconductor memory and generally controls each element of the liquid ejecting apparatus 100. The control unit 20 is an example of a "controller". The transport mechanism 22 transports the medium 12 along a Y axis under the control of the control unit 20.

The moving mechanism 24 reciprocates the liquid ejecting head 26 along an X axis under the control of the control unit 20. The X axis intersects the Y axis along which the medium 12 is transported. For example, the X axis and the Y axis are orthogonal to each other. The moving mechanism 24 according to the first embodiment includes a transport body 242 that accommodates the liquid ejecting head 26 and has a substantially box shape, and a transport belt 244 to which the transport body 242 is fixed. Alternatively, a configuration in which a plurality of liquid ejecting heads 26 are mounted on the transport body 242 or a configuration in which the liquid container 14 is mounted on the transport body 242 together with the liquid ejecting heads 26 can be adopted.

The liquid ejecting head 26 ejects the ink supplied from the liquid container 14 from a plurality of nozzles N to the medium 12 under the control of the control unit 20. Each of the liquid ejecting heads 26 ejects the ink to the medium 12 in parallel with the transport of the medium 12 by the transport mechanism 22 and repetitive reciprocation of the transport body 242 to form a desired image on a surface of the medium 12. Note that, in the following description, an axis perpendicular to an XY plane will hereinafter be referred to as a Z axis. The Z axis is typically a vertical line. The XY plane is, for example, a plane parallel to the surface of the medium 12. The liquid ejecting head 26 includes a plurality of nozzles N arranged in the Y-axis direction.

Figure 2:
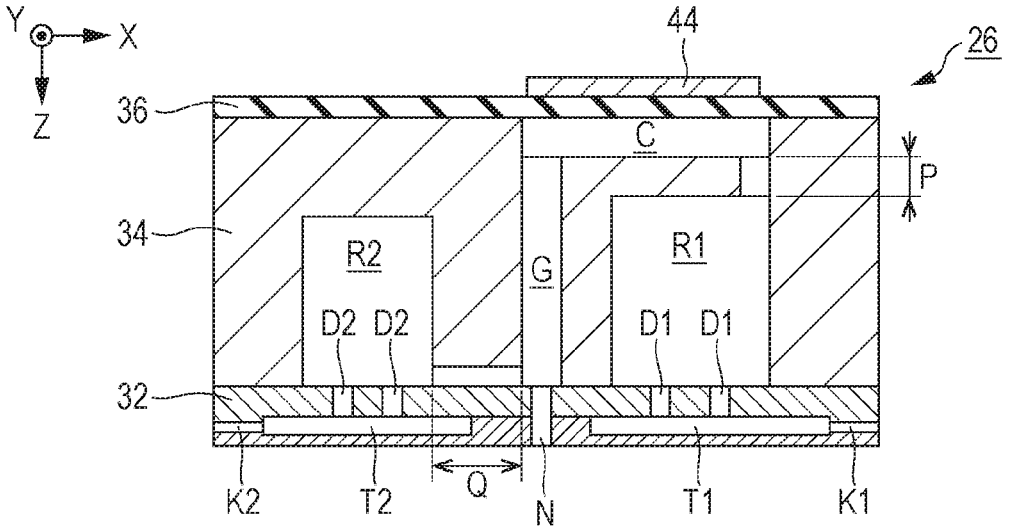
FIG. 2 is a sectional view of a liquid ejecting head.
Figure 3:
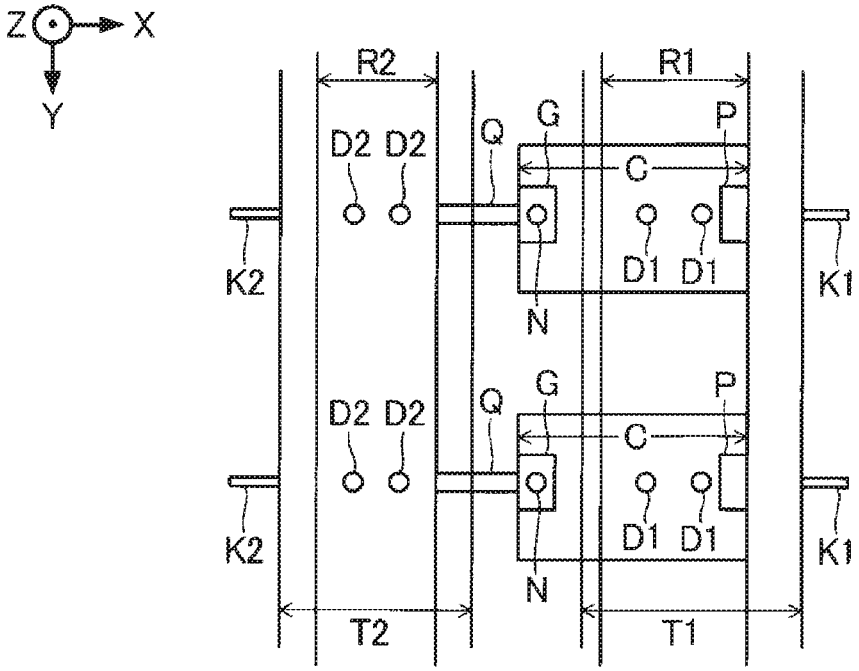
FIG. 3 is a plan view of the liquid ejecting head.

FIG. 2 is a sectional view of the liquid ejecting head 26 taken along line II-II in FIG. 1, and FIG. 3 is a plan view of the liquid ejecting head 26. As illustrated in FIG. 2, the liquid ejecting head 26 includes a nozzle substrate 32, a flow path substrate 34, and a vibration plate 36. The nozzle substrate 32, the flow path substrate 34, and the vibration plate 36 are long plate-like members along the Y axis, and are joined to each other using, for example, an adhesive. The nozzle substrate 32 and the vibration plate 36 are joined to opposite sides of the flow path substrate 34, respectively, with the flow path substrate 34 interposed therebetween. Specifically, the nozzle substrate 32 is joined to a surface of the flow path substrate 34 in the positive direction of the Z axis, and the vibration plate 36 is joined to a surface of the flow path substrate 34 in the negative direction of the Z axis. Note that the flow path substrate 34 and the nozzle substrate 32 are formed by processing a single crystal substrate of, for example, silicon (Si), by a semiconductor manufacturing technique such as etching. A plurality of nozzles N arranged in the Y-axis direction are formed in the nozzle substrate 32. Each nozzle N is a through-hole through which ink passes.

The flow path substrate 34 is a member for forming a flow path of the ink. In the flow path substrate 34, a first liquid storage chamber R1, a pressure chamber C, a supply flow path P, a discharge flow path Q, a coupling flow path G, and a second liquid storage chamber R2 are formed. As illustrated in FIG. 3, the first liquid storage chamber R1 and the second liquid storage chamber R2 are long spaces formed along the Y axis in plan view so as to be continuous over the plurality of nozzles N. On the other hand, the pressure chamber C, the supply flow path P, and the discharge flow path Q are spaces formed individually for each of the nozzles N. As illustrated in FIG. 2, the first liquid storage chamber R1 and the second liquid storage chamber R2 are formed at the surface of the flow path substrate 34 in the positive direction of the Z axis. The first liquid storage chamber R1 and the second liquid storage chamber R2 are positioned on opposite sides, respectively, with the nozzle N interposed therebetween in plan view from the Z-axis direction. The pressure chamber C is formed at the surface of the flow path substrate 34 in the negative direction of the Z axis. The ink supplied from the liquid container 14 is stored in the first liquid storage chamber R1.

The supply flow path P is a flow path that communicates with the first liquid storage chamber R1 and the pressure chamber C. As illustrated in FIG. 3, the width of the supply flow path P in the Y-axis direction is smaller than that of the pressure chamber C in the Y-axis direction. The coupling flow path G is a flow path that communicates with the pressure chamber C and the nozzle N. An end portion of the coupling flow path G in the positive direction of the Z axis is coupled to the nozzle N. In plan view, the nozzle N and the coupling flow path G overlap each other. The width of the coupling flow path G in the Y-axis direction is smaller than that of the pressure chamber C in the Y-axis direction.

In the flow path substrate 34, a plurality of pressure chambers C corresponding to different nozzles N are formed along the Y axis. Each pressure chamber C is a long opening along the X axis in plan view from the Z-axis direction. Each pressure chamber C is a space for applying a pressure to the ink in the pressure chamber C. An end portion of the pressure chamber C in the positive direction of the X axis overlaps the supply flow path P in plan view, and an end portion of the pressure chamber C in the negative direction of the X axis overlaps the coupling flow path G in plan view. The flow of ink stored in the liquid storage chamber R branches at the supply flow paths P and the ink is supplied to and fills the plurality of pressure chambers C in parallel. The pressure chamber C communicates with the nozzle N via the coupling flow path G.

The vibration plate 36 is a plate-like member that can be elastically deformed. For example, the vibration plate 36 is configured by laminating a first layer formed of silicon oxide ($SiO_2$) and a second layer formed of zirconium oxide ($ZrO_2$).

As illustrated in FIG. 2, a plurality of piezoelectric elements 44 corresponding to different nozzles N are installed at a surface of the vibration plate 36 opposite from the pressure chamber C. Each piezoelectric element 44 is a driving element that causes a pressure to fluctuate in the pressure chamber C. Specifically, the piezoelectric element 44 is an actuator deformed by supplying a drive waveform and is formed in a long shape along the X-axis direction in plan view. The plurality of piezoelectric elements 44 are arranged in the Y-axis direction so as to correspond to the plurality of pressure chambers C. When the vibration plate 36 vibrates in conjunction with deformation of the piezoelectric element 44, the pressure in the pressure chamber C fluctuates, such that the ink in the pressure chamber C passes through a communication flow path G and the nozzle N and is then ejected.

The discharge flow path Q is a flow path formed at the surface of the flow path substrate 34 in the positive direction of the Z axis and coupling the coupling flow path G and the second liquid storage chamber R2 to each other. The discharge flow path Q is coupled to an end portion of the coupling flow path G in the positive direction of the Z axis. Specifically, the discharge flow path Q is a flow path through which ink that is not ejected from the nozzle N, of the ink that passed through the pressure chamber C, is discharged. As illustrated in FIG. 3, a width of the discharge flow path Q in the Y-axis direction is smaller than that of the coupling flow path G in the Y-axis direction, for example. The ink that passed through the discharge flow path Q is discharged to the second liquid storage chamber R2. The ink discharged from each discharge flow path Q to the second liquid storage chamber R2 is returned to the first liquid storage chamber R1 by a circulation mechanism including, for example, a pump and the like.

As illustrated in FIG. 2, first hole portions D1, a first damper chamber T1, and a first communication hole K1 are formed in the nozzle substrate 32. The first hole portions D1, the first damper chamber T1, and the first communication hole K1 are formed on a side opposite from the second liquid storage chamber R2 with respect to an array of the plurality of nozzles N. The first damper chamber T1 is a space that is continuous over the plurality of nozzles N. The first communication hole K1 is formed, for example, for each nozzle N.

The first hole portions D1 are formed at a surface of the nozzle substrate 32 adjacent to the flow path substrate 34. As illustrated in FIG. 3, a plurality of first hole portions D1 are formed at positions overlapping the first liquid storage chamber R1 in plan view from the Z-axis direction. Alternatively, the number of first hole portions D1 may be one. An inner diameter of the first hole portion D1 is, for example, substantially equal to that of the nozzle N. Alternatively, the inner diameter of the first hole portion D1 may be smaller than that of the nozzle N. The inner diameter of the first hole portion D1 is a diameter in a cross-sectional area of the first hole portion D1. A meniscus for absorbing a pressure fluctuation of the ink in the first liquid storage chamber R1 is formed in the first hole portion D1. Specifically, the meniscus in the first hole portion D1 vibrates in accordance with the pressure fluctuation propagated from the pressure chamber C to the first liquid storage chamber R1 via the supply flow path P, and the pressure fluctuation is thus absorbed. Note that a configuration in which the plurality of first hole portions D1 are arranged along the X axis is illustrated in FIGS. 2 and 3, but the plurality of first hole portions D1 may be formed at any appropriate positions.

The first damper chamber T1 is a space that communicates with the first liquid storage chamber R1 via the first hole portions D1. The first damper chamber T1 is formed so as to be continuous over the plurality of first hole portions D1. In plan view, the plurality of first hole portions D1 and the first damper chamber T1 overlap each other. The first communication hole K1 is a space that communicates with the first damper chamber T1 and an external space. That is, the first damper chamber T1 is opened to the atmosphere. The first communication hole K1 is formed, for example, from an inner wall of the first damper chamber T1 toward a side surface of the nozzle substrate 32. Alternatively, the first communication hole K1 may be formed from the inner wall of the first damper chamber T1 toward a surface of the nozzle substrate 32 opposite from the flow path substrate 34. An inner diameter of the first communication hole K1 is smaller than that of the first hole portion D1.

In addition, second hole portions D2, a second damper chamber T2, and a second communication hole K2 are formed in the nozzle substrate 32. The second hole portions D2, the second damper chamber T2, and the second communication hole K2 are formed on a side opposite from the first liquid storage chamber R1 with respect to the array of the plurality of nozzles N. The second damper chamber T2 is a space that is continuous over the plurality of nozzles N. The second communication hole K2 is formed, for example, for each nozzle N.

Note that the first communication hole K1 and the second communication hole K2 are formed for each nozzle N in the first embodiment, but the first communication hole K1 and the second communication hole K2 may not be formed for each nozzle N. For example, one or more first communication holes K1 may be formed in the first damper chamber T1 regardless of the number of nozzles N. Similarly, one or more second communication holes K2 may be formed in the second damper chamber T2 regardless of the number of nozzles N. In addition, when a plurality of nozzles N are formed for one pressure chamber C and one pixel is formed at the medium 12 by the plurality of nozzles N in the liquid ejecting head 26, the first communication hole K1 and the second communication hole K2 may be formed for each pressure chamber C.

The second hole portions D2 are formed at the surface of the nozzle substrate 32 adjacent to the flow path substrate 34. As illustrated in FIG. 3, a plurality of second hole portions D2 are formed at positions overlapping the second liquid storage chamber R2 in plan view from the Z-axis direction. Alternatively, the number of second hole portions D2 may be one. An inner diameter of the second hole portion D2 is, for example, substantially equal to that of the nozzle N. Alternatively, the inner diameter of the second hole portion D2 may be smaller than that of the nozzle N. The inner diameter of the second hole portion D2 is a diameter in a cross-sectional area of the second hole portion D2. A meniscus for absorbing a pressure fluctuation of the ink in the second liquid storage chamber R2 is formed in the second hole portion D2. Specifically, the meniscus in the second hole portion D2 vibrates in accordance with the pressure fluctuation propagated from the pressure chamber C to the second liquid storage chamber R2 via the coupling flow path G and the discharge flow path Q, and the pressure fluctuation is thus absorbed. Note that a configuration in which the plurality of second hole portions D2 are arranged along the X axis is illustrated in FIGS. 2 and 3, but the plurality of second hole portions D2 are formed at any appropriate positions.

The inner diameters of the first hole portion D1 and the second hole portion D2 are preferably equal to or smaller than the inner diameter of the nozzle N also from the viewpoint of maintaining vibration absorption performance without ejecting the ink from the first hole portion D1 and the second hole portion D2. In particular, a configuration in which the inner diameters of the first hole portion D1 and the second hole portion D2 are smaller than the inner diameter of the nozzle N is preferable. Cross-sectional shapes of the nozzle N, the first hole portion D1, and the second hole portion D2 are not restrictive to circular shapes, and may be, for example, polygonal shapes such as quadrangular shapes or pentagonal shapes or may be elliptical shapes. For example, in a configuration in which the cross-sectional shapes of the nozzle N, the first hole portion D1, and the second hole portion D2 are shapes other than the circular shapes, diameters of the circular shapes having the same cross-sectional area are inner diameters of the nozzle N, the first hole portion D1, and the second hole portion D2. In a configuration in which the inner diameters of the nozzle N, the first hole portion D1, and the second hole portion D2 change in accordance with a position on the Z axis, the inner diameters are calculated from a size of an opening in the positive direction of the Z axis.

The second damper chamber T2 is a space that communicates with the second liquid storage chamber R2 via the second hole portions D2. The second damper chamber T2 is formed so as to be continuous over the plurality of second hole portions D2. In plan view, the plurality of second hole portions D2 and the second damper chamber T2 overlap each other. The second communication hole K2 is a space that communicates with the second damper chamber T2 and an external space. That is, the second damper chamber T2 is opened to the atmosphere. The second communication hole K2 is formed, for example, from an inner wall of the second damper chamber T2 toward a side surface of the nozzle substrate 32. Alternatively, the second communication hole K2 may be formed from the inner wall of the second damper chamber T2 toward a surface of the nozzle substrate 32 opposite from the flow path substrate 34. An inner diameter of the second communication hole K2 is smaller than that of the second hole portion D2.

Figure 4:
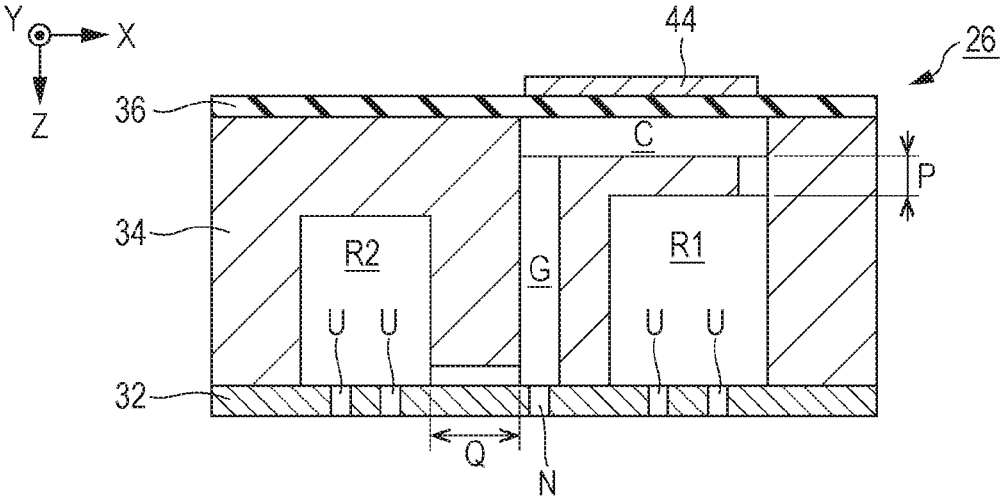
FIG. 4 is a sectional view of a liquid ejecting head according to Comparative Example 1.

FIG. 4 is a sectional view of the liquid ejecting head 26 in a configuration (hereinafter, referred to as "Comparative Example 1") in which a meniscus for absorbing a pressure fluctuation of the ink in the first liquid storage chamber R1 is formed in a through-hole U penetrating the nozzle substrate 32. In Comparative Example 1, since the through-hole U is exposed to an external space, the ink in the first liquid storage chamber R1 dries and a viscosity of the ink thus increases. Therefore, there is a problem that performance of absorbing the pressure fluctuation by the meniscus in the through-hole U is deteriorated. On the other hand, in the first embodiment, the first hole portion D1, in which the meniscus for absorbing the pressure fluctuation in the first liquid storage chamber R1 is formed, is formed inside the first damper chamber T1. Therefore, drying of the ink in the first liquid storage chamber R1 can be suppressed as compared with Comparative Example 1. That is, deterioration in vibration absorption performance due to the drying of the ink in the first liquid storage chamber R1 can be reduced.

According to the configuration of the first embodiment in which the first damper chamber T1 communicating with the first hole portion D1 is formed, there is an advantage that it is easy for the meniscus formed in the first hole portion D1 to absorb the pressure fluctuation in the first liquid storage chamber R1, as compared with a configuration in which the first damper chamber T1 is not formed.

According to the configuration of the first embodiment in which the plurality of first hole portions D1 communicating with the first damper chamber T1 are formed, it is easy to sufficiently absorb the pressure fluctuation in the first liquid storage chamber R1. In the first embodiment, according to the configuration of the first embodiment in which the nozzle substrate 32 has the first communication hole K1, it is easy to sufficiently absorb the pressure fluctuation as compared with a configuration in which the first damper chamber T1 is sealed. Note that an effect of each component in the first hole portion D1 and the first damper chamber T1 illustrated above is similarly realized in the second hole portion D2 and the second damper chamber T2.

B. Second Embodiment

A second embodiment will be described. Note that, in each of the following examples, elements having the same or similar functions as those in the first embodiment will be denoted by the reference numerals used in the description of the first embodiment, and a detailed description thereof will be appropriately omitted.

Figure 5:
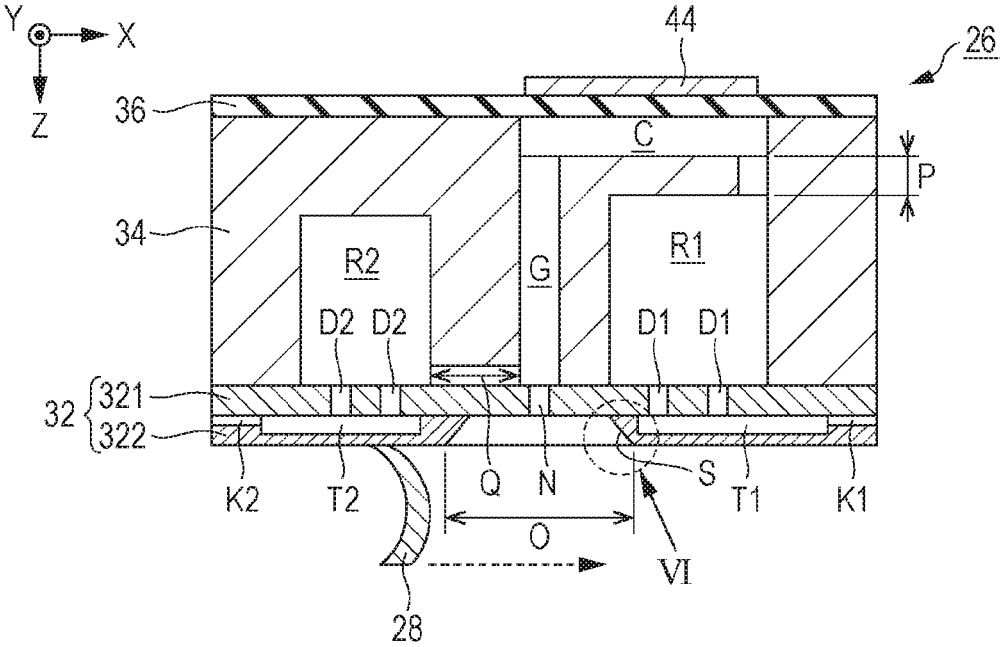
FIG. 5 is a sectional view of a liquid ejecting head according to a second embodiment.

FIG. 5 is a sectional view of a liquid ejecting head 26 according to the second embodiment. As illustrated in FIG. 5, a nozzle substrate 32 according to the second embodiment includes a first substrate 321 and a second substrate 322. The first substrate 321 is joined to a flow path substrate 34, and the second substrate 322 is joined to a surface of the first substrate 321 opposite from the flow path substrate 34. That is, the first substrate 321 is positioned between the second substrate 322 and the flow path substrate 34. A surface of the second substrate 322 is formed of a water-repellent film from the viewpoint of suppressing adhesion of ink to the surface of the second substrate 322. Note that the second substrate 322 is attachable to and detachable from the first substrate 321.

Nozzles N, first hole portions D1, and second hole portions D2 are formed in the first substrate 321. The nozzles N, the first hole portions D1, and the second hole portions D2 are through-holes penetrating the first substrate 321. Note that positions where the nozzles N, the first hole portions D1, and the second hole portions D2 are formed in plan view are the same as those in the first embodiment.

Figure 6:
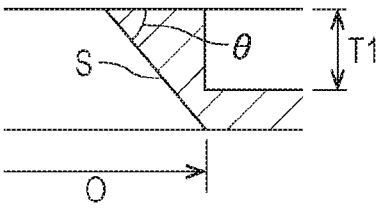
FIG. 6 is an enlarged view in the vicinity of a nozzle surface.

An opening portion O exposing the nozzles N is formed in the second substrate 322. Specifically, the opening portion O is a through-hole formed along the Y-axis direction so as to expose an entire array of a plurality of nozzles N. As illustrated in FIG. 5, a surface S (hereinafter, referred to as a "nozzle surface") adjacent to the nozzles N among side surfaces of the second substrate 322 is inclined with respect to the surface of the first substrate 321. The nozzle surface S can also be referred to as a surface extending along the Y axis among inner walls in the opening portion O of the second substrate 322. FIG. 6 is an enlarged sectional view of the vicinity VI of the nozzle surface S in FIG. 5. Specifically, as illustrated in FIG. 6, the nozzle surface S forms an angle θ with the surface of the first substrate 321. Specifically, the angle θ is an angle larger than 0° and smaller than 90°. The angle θ is, for example, 30°, 45°, or 60°.

In addition, a first damper chamber T1, a first communication hole K1, a second damper chamber T2, and a second communication hole K2 are formed in the second substrate 322. The first damper chamber T1 and the first communication hole K1 are formed in a region of the second substrate 322 in the positive direction of the X axis with respect to the opening portion O, and the second damper chamber T2 and the second communication hole K2 are formed in a region of the second substrate 322 in the negative direction of the X axis with respect to the opening portion O.

The first damper chamber T1, the first communication hole K1, the second damper chamber T2, and the second communication hole K2 are spaces formed at a surface of the second substrate 322 facing the first substrate 321, and have upper surfaces closed by the first substrate 321. Similarly to the first embodiment, the first damper chamber T1 communicates with a plurality of first hole portions D1, and the first communication hole K1 communicates with the first damper chamber T1 and an external space. In addition, similarly to the first embodiment, the second damper chamber T2 communicates with a plurality of second hole portions D2, and the second communication hole K2 communicates with the second damper chamber T2 and an external space.

As illustrated in FIG. 5, a liquid ejecting apparatus 100 according to a second embodiment includes a wiping portion 28. The wiping portion 28 is used for cleaning the liquid ejecting head 26. For example, a plate-like member formed in a rectangular shape by an elastic material is used as the wiping portion 28. The wiping portion 28 wipes ink on a surface of the nozzle substrate 32 in a state of being in contact with the surface of the nozzle substrate 32. The control unit 20 relatively moves the wiping portion 28 along an X-axis direction in contact with the surface of the nozzle substrate 32. Therefore, the ink adhered to the entire region of the surface of the nozzle substrate 32 is wiped by the wiping portion 28. The wiping portion 28 moves, for example, from the negative direction of the X axis to the Y-axis direction on the nozzle substrate 32. In other words, the wiping portion 28 moves on the surface of the nozzle substrate 32 in order of a surface of the region of the second substrate 322 in the negative direction of the X axis→a surface of a region of the first substrate 321 where the nozzles N are formed→a surface of the region of the second substrate 322 in the positive direction of the X axis.

Also in the second embodiment, the same effects as those in the first embodiment are realized. Also in the second embodiment, since the nozzles N and the first hole portions D1 are formed in the first substrate 321 and the first damper chamber T1 is formed in the second substrate 322, the nozzles N, the first hole portions D1, and the first damper chamber T1 can be easily formed as compared with a configuration in which the nozzles N, the first hole portions D1, and the first damper chamber T1 are formed in a common substrate. In addition, in the second embodiment, since the second substrate 322 is attachable and detachable, a maintenance work of the liquid ejecting head 26 can be performed by, for example, removing the second substrate 322. Note that the above effects are similarly realized in the second hole portions D2 and the second damper chamber T2.

Here, in a configuration (hereinafter, referred to as "Comparative Example 2") in which the nozzle surface S of the second substrate 322 is a vertical surface orthogonal to the surface of the first substrate 321, there is a problem that it is difficult for the wiping portion 28 to move on the surface of the nozzle substrate 32. For example, when the wiping portion 28 moves from the surface of the first substrate 321 to the surface of the second substrate 322, a tip of the wiping portion 28 is caught by the nozzle surface S to hinder the movement of the wiping portion 28. On the other hand, in the second embodiment, since the nozzle surface S of the second substrate 322 is an inclined surface inclined at the angle θ larger than 0° and smaller than 90° with respect to the surface of the first substrate 321, there is an advantage that it is easy for the wiping portion 28 to move on the surface of the nozzle substrate 32, as compared with Comparative Example 2.

Further, in Comparative Example 2, it is difficult for the wiping portion 28 to be in contact with the nozzle surface S, and it is likely that the wiping portion 28 cannot wipe the ink attached to the nozzle surface S. On the other hand, according to a configuration of the second embodiment in which the inclined surface inclined at the angle θ larger than 0° and smaller than 90° with respect to the surface of the first substrate 321 is used as the nozzle surface S, for example, when the wiping portion 28 moves from the surface of the second substrate 322 to the surface of the first substrate 321, the nozzle surface S can be continuously wiped from the first substrate 321. Therefore, the wiping portion 28 can sufficiently wipe the ink adhered to the nozzle surface S as compared with Comparative Example 2.

C. Modification

Each embodiment illustrated above can be variously modified. Aspects of specific modifications that can be applied to each of the embodiments described above will be illustrated below. Note that two or more aspects appropriately selected from the following examples can be appropriately combined with each other in a range in which they do not contradict each other.

Figure 7:
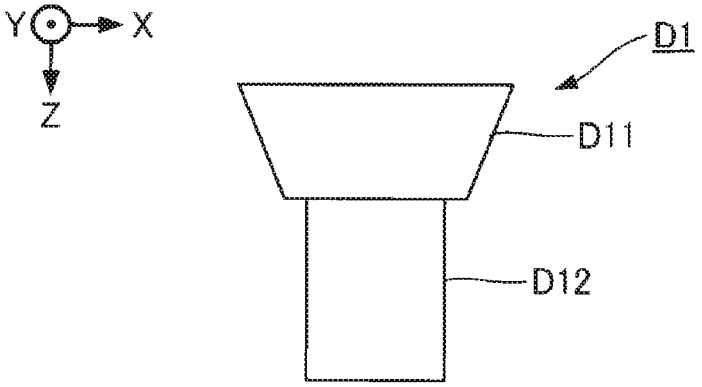
FIG. 7 is a sectional view of a first hole portion according to a modification.

(1) In each of the embodiments described above, a configuration in which the inner diameter of the first hole portion D1 is constant over the entire length is illustrated, but the inner diameter of the first hole portion D1 may be made different along a position on the Z axis. FIG. 7 is a sectional view of a first hole portion D1 according to a modification. As illustrated in FIG. 7, the first hole portion D1 includes a first portion D11 and a second portion D12 having a different inner diameter. The first portion D11 is positioned in the negative direction of the Z axis in the first hole portion D1, and the second portion D12 is positioned in the positive direction of the Z axis in the first hole portion D1. That is, the first portion D11 is positioned between the flow path substrate 34 and the second portion D12. The first portion D11 has a tapered shape in which an inner diameter of a portion adjacent to the flow path substrate 34 is larger than that of a portion adjacent to the second portion D12. The second portion D12 has a cylindrical shape in which an inner diameter is constant over the entire length. The inner diameter of the first portion D11 is larger than that of the second portion D12. For example, the inner diameter of the first portion D11 is larger than that of the second portion D12 over the entire length of the first portion D11.

For example, in a configuration in which the inner diameter of the first hole portion D1 is decreased over the entire length of the first hole portion D1, there is a problem that the meniscus formed in the first hole portion D1 cannot sufficiently absorb the pressure fluctuation of the first liquid storage chamber R1. On the other hand, for example, in a configuration in which the inner diameter of the first hole portion D1 is increased over the entire length of the first hole portion D1, there is a problem that the ink leaks from the first hole portion D1. In the first embodiment, however, since the inner diameter of the first portion D11 is larger than the inner diameter of the second portion D12, it is possible to reduce a possibility that the ink will leak from the first hole portion D1 while sufficiently absorbing the pressure fluctuation of the first liquid storage chamber R1 by forming a meniscus in the second portion D12. In addition, since a state in which the meniscus is formed in the second portion D12 is maintained, it is possible to reduce a variation in a position where the meniscus is formed in the first hole portion D1. Therefore, it is possible to reduce a possibility that an amount of absorption, by the first hole portion D1, of the pressure fluctuation of the first liquid storage chamber R1 will vary for each nozzle N. Note that the second hole portion D2 and the nozzle N may also include a plurality of portions having different inner diameters. As understood from the above description, shapes of the first hole portion D1 and the second hole portion D2 are appropriately selected.

(2) In each of the embodiments described above, one of the first damper chamber T1 and the second damper chamber T2 may be pressurized. For example, when the liquid ejecting head 26 is tilted and a pressure difference is generated between the first damper chamber T1 and the second damper chamber T2, it is possible to make a pressure in the first damper chamber T1 and a pressure in the second damper chamber T2 close to each other by pressurizing one of the first damper chamber T1 and the second damper chamber T2.

(3) In each of the embodiments described above, the first communication hole K1 and the second communication hole K2 are formed in the nozzle substrate 32, but one or both of the first communication hole K1 and the second communication hole K2 may be omitted from the nozzle substrate 32. That is, a configuration in which the first damper chamber T1 or the second damper chamber T2 does not communicate with an external space is also adopted.

(4) In each of the embodiments described above, the flow path substrate 34 may be composed of a plurality of members. For example, the flow path substrate 34 may be composed of a first flow path substrate in which a pressure chamber C is formed and a second flow path substrate in which a first liquid storage chamber R1, a supply flow path P, a coupling flow path G, a discharge flow path Q, and a second liquid storage chamber R2 are formed.

(5) In each of the embodiments described above, the second hole portions D2 and the second damper chamber T2 may be omitted.

(6) In each of the embodiments described above, a configuration in which the ink discharged from each discharge flow path Q to the second liquid storage chamber R2 is returned to the first liquid storage chamber R1 is illustrated, but a configuration in which the ink that is not ejected from the nozzles N is returned is not essential. That is, the discharge flow path Q and the second liquid storage chamber R2 are omitted from the liquid ejecting head 26.

Figure 8:
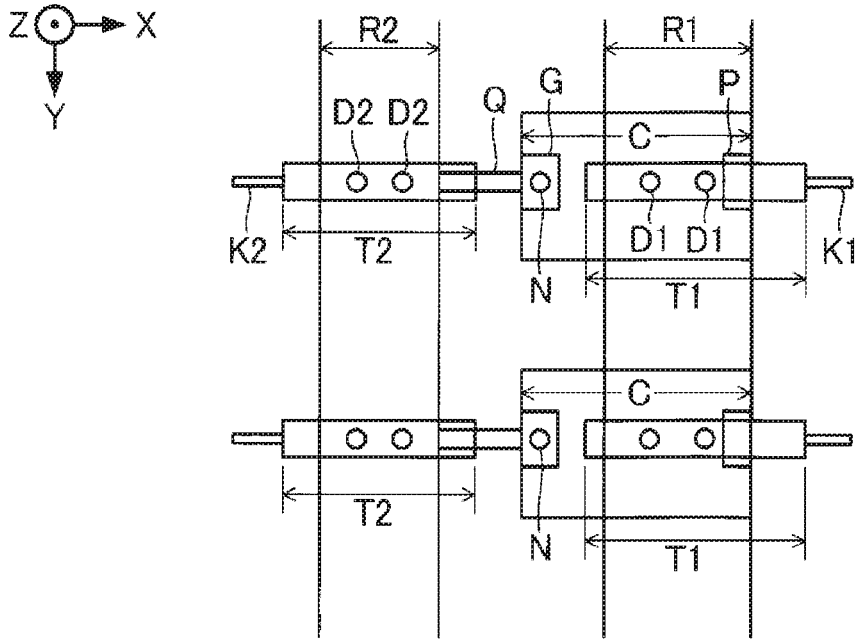
FIG. 8 is a plan view of a liquid ejecting head according to a modification.

(7) In each of the embodiments described above, the first damper chamber T1 and the second damper chamber T2 are formed as spaces that are continuous over the plurality of nozzles N, but the first damper chamber T1 and the second damper chamber T2 may be formed for each of the plurality of nozzles N, as illustrated in FIG. 8.

(8) In each of the embodiments described above, a serial-type liquid ejecting apparatus 100 in which the transport body 242, on which the liquid ejecting head 26 is mounted, is reciprocated is illustrated, but the present disclosure is also applicable to a line-type liquid ejecting apparatus in which the plurality of nozzles N are allocated over the entire width of the medium 12.

(9) The driving element that causes the liquid in the pressure chamber C to be ejected from the nozzle N is not restrictive to the piezoelectric element 44 illustrated in each of the embodiments described above. For example, a heating element that generates air bubbles in the pressure chamber C by heating to cause a pressure to fluctuate can be used as the driving element. As understood from the above illustrations, the driving element is comprehensively expressed as an element that causes the liquid in the pressure chamber C to be ejected from the nozzle N, and a method for operating the driving element such as a piezoelectric or heating method, and a specific configuration of the driving element are not specifically determined.

(10) The liquid ejecting apparatus 100 illustrated in each of the embodiments described above can be adopted in various apparatuses such as a facsimile apparatus or a copying machine, in addition to an apparatus dedicated to printing. Use of the liquid ejecting apparatus according to the present disclosure is not limited to the printing. For example, a liquid ejecting apparatus that ejects a solution of a coloring material is used as a manufacturing apparatus that forms a color filter of a display apparatus such as a liquid crystal display panel. In addition, a liquid ejecting apparatus that ejects a solution of a conductive material is used as a manufacturing apparatus that forms wires and electrodes of a wiring board. In addition, a liquid ejecting apparatus that ejects a solution of an organic matter relating to a living body is used as a manufacturing apparatus that manufactures, for example, a biochip.

What is claimed is:

1. A liquid ejecting head comprising:
a nozzle substrate in which a nozzle that ejects a liquid is formed; and
a flow path substrate that is joined to the nozzle substrate, wherein the flow path substrate includes
a pressure chamber that communicates with the nozzle and
a first liquid storage chamber that stores the liquid to be supplied to the pressure chamber, and
the nozzle substrate includes
a first damper chamber and
one or more first hole portions which communicate with the first liquid storage chamber and the first damper chamber and in which a meniscus for absorbing a pressure fluctuation of the liquid in the first liquid storage chamber is formed, wherein the nozzle substrate includes a communication hole that communicates with the first damper chamber and an external space.

2. The liquid ejecting head according to claim 1, wherein in the nozzle substrate,
the one or more first hole portions are a plurality of first hole portions, and
the first damper chamber communicates with the plurality of first hole portions.

3. The liquid ejecting head according to claim 1, wherein
the nozzle substrate includes a first substrate and a second substrate,
the first substrate is positioned between the flow path substrate and the second substrate,
the nozzle and the one or more first hole portions are formed in the first substrate, and
the first damper chamber is formed in the second substrate.

4. The liquid ejecting head according to claim 3, wherein the second substrate is configured to be attached and detached.

5. The liquid ejecting head according to claim 3, wherein a surface, among side surfaces of the second substrate, adjacent to the nozzle is an inclined surface inclined at an angle smaller than 90° with respect to a surface of the first substrate.

6. The liquid ejecting head according to claim 3, wherein a surface of the second substrate is a water-repellent film.

7. The liquid ejecting head according to claim 1, wherein the one or more first hole portions each include a first portion and a second portion,
the first portion is positioned between the flow path substrate and the second portion, and
an inner diameter of the first portion is larger than an inner diameter of the second portion.

8. The liquid ejecting head according to claim 1, wherein the flow path substrate includes
a discharge flow path through which a liquid that is not ejected from the nozzle, of the liquid that passed through the pressure chamber, is discharged and
a second liquid storage chamber to which the liquid that passed through the discharge flow path is discharged, and
the nozzle substrate includes
a second damper chamber and
one or more second hole portions which communicate with the second liquid storage chamber and the second damper chamber and in which a meniscus for absorbing a pressure fluctuation of the liquid in the second liquid storage chamber is formed.

9. The liquid ejecting head according to claim 8, wherein in the nozzle substrate,
the one or more second hole portions are a plurality of second hole portions, and
the second damper chamber communicates with the plurality of second hole portions.

10. A liquid ejecting apparatus comprising:
the liquid ejecting head according to claim 1; and
a controller that controls the liquid ejecting head.

11. The liquid ejecting apparatus according to claim 10, wherein one of the first damper chamber and the second damper chamber is pressurized.

12. A liquid ejecting apparatus comprising:
the liquid ejecting head according to claim 2; and
a controller that controls the liquid ejecting head.

13. A liquid ejecting apparatus comprising:
the liquid ejecting head according to claim 3; and
a controller that controls the liquid ejecting head.

14. A liquid ejecting apparatus comprising:
the liquid ejecting head according to claim 4; and
a controller that controls the liquid ejecting head.

15. A liquid ejecting apparatus comprising:
the liquid ejecting head according to claim 5; and
a controller that controls the liquid ejecting head.

16. A liquid ejecting apparatus comprising:
the liquid ejecting head according to claim 6; and
a controller that controls the liquid ejecting head.

17. A liquid ejecting apparatus comprising:
the liquid ejecting head according to claim 7; and
a controller that controls the liquid ejecting head.

18. A liquid ejecting apparatus comprising:
the liquid ejecting head according to claim 8; and
a controller that controls the liquid ejecting head.

* * * * *